US006239398B1

(12) United States Patent
Doughty et al.

(10) Patent No.: US 6,239,398 B1
(45) Date of Patent: May 29, 2001

(54) CASSETTE ASSEMBLY WITH REJECTION FEATURES

(75) Inventors: Dennis J. Doughty, Plainville; Julian Monzon, West Hartford; Dave Christensen, Sandy Hook; Randy Greenberg, Granby, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/627,738

(22) Filed: Jul. 28, 2000

Related U.S. Application Data

(62) Division of application No. 09/512,980, filed on Feb. 24, 2000.

(51) Int. Cl.[7] ..... H01H 9/44

(52) U.S. Cl. ..... 218/22; 335/16; 335/202

(58) Field of Search ..... 335/16, 147, 195, 335/202; 218/22, 7, 154–6

(56) References Cited

U.S. PATENT DOCUMENTS

| | | | | |
|---|---|---|---|---|
| D. 367,265 | | 2/1996 | Yamagata et al. . | |
| 2,244,061 | * | 6/1941 | Graves | 218/155 |
| 2,340,682 | | 2/1944 | Powell . | |
| 2,363,606 | * | 11/1944 | Maseng | 218/154 |
| 2,719,203 | * | 9/1955 | Gelzheiser et al. | 218/155 |
| 2,937,254 | | 5/1960 | Ericson . | |
| 3,158,717 | | 11/1964 | Jencks et al. . | |
| 3,162,739 | | 12/1964 | Klein et al. . | |
| 3,197,582 | | 7/1965 | Norden . | |
| 3,198,915 | * | 8/1965 | Wortmann | 335/172 |
| 3,307,002 | | 2/1967 | Cooper . | |
| 3,517,356 | | 6/1970 | Hanafusa . | |
| 3,631,369 | | 12/1971 | Menocal . | |
| 3,803,455 | | 4/1974 | Willard . | |
| 3,883,781 | | 5/1975 | Cotton . | |
| 4,129,762 | | 12/1978 | Bruchet . | |
| 4,144,513 | | 3/1979 | Shafer et al. . | |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 196 241 | 10/1986 | (EP) . |

(List continued on next page.)

*Primary Examiner*—Lincoln Donovan
(74) *Attorney, Agent, or Firm*—Cantor Colburn LLP; Carl B. Horton

(57) ABSTRACT

A cassette assembly for rotary contact circuit breakers utilizing a first electrically insulative cassette half piece and a second electrically insulative cassette half piece which are arranged to mate with each other to form an enclosure. The electrically insulative cassette half pieces include improper installation rejection features for both the rotor and arc chute assemblies. The inner surface of a electrically insulative cassette half piece including a groove and recesses formed therein. A rotor is properly positioned within the electrically insulative cassette half piece by inserting a pin on the face of the rotor into the groove. An arc chute assembly is properly positioned within the electrically insulative cassette half piece by inserting a tab located on a side member of the arc chute assembly into a corresponding recess located in the electrically insulative cassette half piece.

8 Claims, 3 Drawing Sheets

U.S. PATENT DOCUMENTS

| | | |
|---|---|---|
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamat . |
| 4,263,492 | 4/1981 | Maier et al. . |
| 4,276,527 | 6/1981 | Gerbert-Gaillard et al. . |
| 4,297,663 | 10/1981 | Seymour et al. . |
| 4,301,342 | 11/1981 | Castonguay et al. . |
| 4,360,852 | 11/1982 | Gilmore . |
| 4,368,444 | 1/1983 | Preuss et al. . |
| 4,375,021 | 2/1983 | Pardini et al. . |
| 4,375,022 | 2/1983 | Daussin et al. . |
| 4,376,270 | 3/1983 | Staffen . |
| 4,383,146 | 5/1983 | Bur . |
| 4,392,036 | 7/1983 | Troebel et al. . |
| 4,393,283 | 7/1983 | Masuda . |
| 4,401,872 | 8/1983 | Boichot-Castagne et al. . |
| 4,409,573 | 10/1983 | DiMarco et al. . |
| 4,435,690 | 3/1984 | Link et al. . |
| 4,467,297 | 8/1984 | Boichot-Catagne et al. . |
| 4,468,645 | 8/1984 | Gerbert-Gaillard et al. . |
| 4,470,027 | 9/1984 | Link et al. . |
| 4,479,143 | 10/1984 | Watanabe et al. . |
| 4,488,133 | 12/1984 | McClellan et al. . |
| 4,492,941 | 1/1985 | Nagel . |
| 4,541,032 | 9/1985 | Schwab . |
| 4,546,224 | 10/1985 | Mostosi . |
| 4,550,360 | 10/1985 | Dougherty . |
| 4,562,419 | 12/1985 | Preuss et al. . |
| 4,589,052 | 5/1986 | Dougherty . |
| 4,595,312 | 6/1986 | Tamaru et al. . |
| 4,611,187 | 9/1986 | Banfi . |
| 4,612,430 | 9/1986 | Sloan et al. . |
| 4,616,198 | 10/1986 | Pardini . |
| 4,622,444 | 11/1986 | Kandatsu et al. . |
| 4,631,625 | 12/1986 | Alexander et al. . |
| 4,642,431 | 2/1987 | Tedesco et al. . |
| 4,644,438 | 2/1987 | Puccinelli et al. . |
| 4,649,247 | 3/1987 | Preuss et al. . |
| 4,658,322 | 4/1987 | Rivera . |
| 4,672,501 | 6/1987 | Bilac et al. . |
| 4,675,481 | 6/1987 | Markowski et al. . |
| 4,682,264 | 7/1987 | Demeyer . |
| 4,689,712 | 8/1987 | Demeyer . |
| 4,694,373 | 9/1987 | Demeyer . |
| 4,710,845 | 12/1987 | Demeyer . |
| 4,717,985 | 1/1988 | Demeyer . |
| 4,733,211 | 3/1988 | Castonguay et al. . |
| 4,733,321 | 3/1988 | Lindeperg . |
| 4,764,650 | 8/1988 | Bur et al. . |
| 4,768,007 | 8/1988 | Mertz et al. . |
| 4,780,786 | 10/1988 | Weynachter et al. . |
| 4,831,221 | 5/1989 | Yu et al. . |
| 4,870,531 | 9/1989 | Danek . |
| 4,883,931 | 11/1989 | Batteux et al. . |
| 4,884,047 | 11/1989 | Baginski et al. . |
| 4,884,164 | 11/1989 | Dziura et al. . |
| 4,900,882 | 2/1990 | Bernard et al. . |
| 4,910,485 | 3/1990 | Bolongeat-Mobleu et al. . |
| 4,914,541 | 4/1990 | Tripodi et al. . |
| 4,916,420 | 4/1990 | Bartolo et al. . |
| 4,916,421 | 4/1990 | Pardini et al. . |
| 4,926,282 | 5/1990 | McGhie . |
| 4,935,590 | 6/1990 | Malkin et al. . |
| 4,937,706 | 6/1990 | Schueller et al. . |
| 4,939,492 | 7/1990 | Raso et al. . |
| 4,943,691 | 7/1990 | Mertz et al. . |
| 4,943,888 | 7/1990 | Jacob et al. . |
| 4,950,855 | 8/1990 | Bolonegeat-Mobleu et al. . |
| 4,951,019 | 8/1990 | Gula . |
| 4,952,897 | 8/1990 | Barnel et al. . |
| 4,958,135 | 9/1990 | Baginski et al. . |
| 4,965,543 | 10/1990 | Batteux . |
| 4,983,788 | 1/1991 | Pardini . |
| 5,001,313 | 3/1991 | Leclerq et al. . |
| 5,004,878 | 4/1991 | Seymour et al. . |
| 5,029,301 | 7/1991 | Nebon et al. . |
| 5,030,804 | 7/1991 | Abri . |
| 5,057,655 | 10/1991 | Kersusan et al. . |
| 5,077,627 | 12/1991 | Fraisse . |
| 5,083,081 | 1/1992 | Barrault et al. . |
| 5,095,183 | 3/1992 | Raphard et al. . |
| 5,103,198 | 4/1992 | Morel et al. . |
| 5,115,371 | 5/1992 | Tripodi . |
| 5,120,921 | 6/1992 | DiMarco et al. . |
| 5,132,865 | 7/1992 | Mertz et al. . |
| 5,138,121 | 8/1992 | Streich et al. . |
| 5,140,115 | 8/1992 | Morris . |
| 5,153,802 | 10/1992 | Mertz et al. . |
| 5,155,315 | 10/1992 | Malkin et al. . |
| 5,166,483 | 11/1992 | Kersusan et al. . |
| 5,172,087 | 12/1992 | Castonguay et al. . |
| 5,178,504 | 1/1993 | Falchi . |
| 5,184,717 | 2/1993 | Chou et al. . |
| 5,187,339 | 2/1993 | Lissandrin . |
| 5,198,956 | 3/1993 | Dvorak . |
| 5,200,724 | 4/1993 | Gula et al. . |
| 5,210,385 | 5/1993 | Morel et al. . |
| 5,239,150 | 8/1993 | Bolongeat-Mobleu et al. . |
| 5,260,533 | 11/1993 | Livesey et al. . |
| 5,262,744 | 11/1993 | Arnold et al. . |
| 5,280,144 | 1/1994 | Bolongeat-Mobleu et al. . |
| 5,281,776 | 1/1994 | Morel et al. . |
| 5,296,660 | 3/1994 | Morel et al. . |
| 5,296,664 | 3/1994 | Crookston et al. . |
| 5,298,874 * | 3/1994 | Morel et al. ..... 335/8 |
| 5,300,907 | 4/1994 | Nereau et al. . |
| 5,310,971 | 5/1994 | Vial et al. . |
| 5,313,180 | 5/1994 | Vial et al. . |
| 5,317,471 | 5/1994 | Izoard et al. . |
| 5,331,500 | 7/1994 | Corcoles et al. . |
| 5,334,808 | 8/1994 | Bur et al. . |
| 5,341,191 | 8/1994 | Crookston et al. . |
| 5,347,096 | 9/1994 | Bolongeat-Mobleu et al. . |
| 5,347,097 | 9/1994 | Bolongeat-Mobleu et al. . |
| 5,350,892 | 9/1994 | Rozier . |
| 5,357,066 | 10/1994 | Morel et al. . |
| 5,357,068 | 10/1994 | Rozier . |
| 5,357,394 | 10/1994 | Piney . |
| 5,361,052 | 11/1994 | Ferullo et al. . |
| 5,373,130 | 12/1994 | Barrault et al. . |
| 5,379,013 | 1/1995 | Coudert . |
| 5,424,701 | 6/1995 | Castonguary et al. . |
| 5,438,176 | 8/1995 | Bonnardel et al. . |
| 5,440,088 | 8/1995 | Coudert et al. . |
| 5,449,871 | 9/1995 | Batteux et al. . |
| 5,450,048 | 9/1995 | Leger et al. . |
| 5,451,729 | 9/1995 | Onderka et al. . |
| 5,457,295 | 10/1995 | Tanibe et al. . |
| 5,467,069 | 11/1995 | Payet-Burin et al. . |
| 5,469,121 | 11/1995 | Payet-Burin . |
| 5,475,558 | 12/1995 | Barjonnet et al. . |
| 5,477,016 | 12/1995 | Baginski et al. . |
| 5,479,143 | 12/1995 | Payet-Burin . |
| 5,483,212 | 1/1996 | Lankuttis et al. . |
| 5,485,343 | 1/1996 | Santos et al. . |
| 5,493,083 | 2/1996 | Oliver . |
| 5,504,283 | 4/1996 | Lazareth et al. . |
| 5,504,290 | 4/1996 | Baginski et al. . |

| | | | |
|---|---|---|---|
| 5,510,761 | | 4/1996 | Boder et al. . |
| 5,512,720 | | 4/1996 | Coudert et al. . |
| 5,515,018 | | 5/1996 | DiMarco et al. . |
| 5,519,561 | | 5/1996 | Mrenna et al. . |
| 5,534,674 | | 7/1996 | Steffens . |
| 5,534,832 | | 7/1996 | Duchemin et al. . |
| 5,534,835 | | 7/1996 | McColloch et al. . |
| 5,534,840 | | 7/1996 | Cuingnet . |
| 5,539,168 | | 7/1996 | Linzenich . |
| 5,543,595 | | 8/1996 | Mader et al. . |
| 5,552,755 | | 9/1996 | Fello et al. . |
| 5,581,219 | | 12/1996 | Nozawa et al. . |
| 5,589,672 | * | 12/1996 | Uchida et al. ..... 218/34 |
| 5,604,656 | | 2/1997 | Derrick et al. . |
| 5,608,367 | | 3/1997 | Zoller et al. . |
| 5,784,233 | | 7/1998 | Bastard et al. . |

FOREIGN PATENT DOCUMENTS

| | | |
|---|---|---|
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 174 904 | 3/1996 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

CASSETTE ASSEMBLY WITH REJECTION FEATURES

CROSS-REFERENCE TO RELATED APPLICATIONS

This application is a divisional application of U.S. application Ser. No. 09/512,980 filed Feb. 24, 2000, which is hereby incorporated by reference in its entirety.

BACKGROUND OF THE INVENTION

This invention relates generally to a circuit breaker, and, more particularly, to a circuit breaker cassette assembly.

Circuit breakers are one of a variety of overcurrent protective devices used for circuit breaker protection and isolation. The basic function of a circuit breaker is to provide electrical system protection whenever an electrical abnormality occurs in any part of the system. In a rotary contact circuit breaker, current enters the system from a power line. The current passes through a load strap to a stationary contact fixed on the strap and then to a moveable contact. The moveable contact is fixedly attached to an arm, and the arm is mounted to a rotor that in turn is rotatably mounted in a cassette. As long as the fixed contacts are in physical contact with the moveable contacts, the current passes from the fixed contacts to the moveable contacts and out of the circuit breaker to downline electrical devices.

In the event of an overcurrent condition (e.g. a short circuit), extremely high electro-magnetic forces are generated. These electro-magnetic forces repel the movable contact away from the stationary contact. Because the moveable contact is fixedly attached to a rotating arm, the arm pivots and physically separates the stationary and moveable contacts, thus tripping the unit. When the contacts are rapidly opened as is the case during a trip caused by a short circuit event, an arc is produced. Swift extinction of the arc usually entails the resort to electromagnetic or pneumatic means for motivating the arc so as to increase its path length, promote removal of the arc from the breaker contacts, and facilitate cooling and splitting of the arc; all contributing to increasing the arc voltage to a value in excess of the system driving voltage. When the arc voltage surpasses the source voltage, it becomes difficult for the arc voltage to maintain the arc voltage so that the arc is extinguished. Accordingly, there occurs a voltage corresponding to the source voltage between the stationary contact and the moveable contact, thereby carrying out the circuit breaker operation. It is common practice to employ an arc chute assembly to extinguish this resultant arc.

Such arc chute assemblies consist of a plurality of metallic chute plates that are held in stacked, spaced-apart relationship by side panels that are fabricated from electrically non-conductive material. Retention of the chute plates between the side panels is usually achieved by providing the plates with small protrusions that are slipped into a series of radiused notches in the side panels.

Circuit breaker design, and more particularly, cassette design should enable the efficient and proper positioning of the various components, such as the rotor and arc chute assemblies, into the cassette. For example, improper installation of a rotor into a cassette can result in the two cassette half pieces not mating correctly together. Also, care must be taken to ensure that an arc chute assembly is correctly positioned into the cassette. This ensures proper rotation of the moveable contact arm as well as the proper spacing between the moveable contact and the plate closest to the moveable contact. Improper installation of either a rotor or an arc chute assembly into a cassette half piece will require disassembly and reassembly of the cassette. Such disassembly and reassembly is time consuming and can increase the production cost of the circuit breaker.

BRIEF SUMMARY OF THE PRESENT INVENTION

In an exemplary embodiment of the invention, a cassette assembly suitable for use with a rotary contact circuit breaker includes a first electrically insulative cassette half piece having an inner surface with a first recess and a groove formed therein and a second electrically insulative cassette half piece having an inner surface with a third recess formed therein. The second electrically insulative cassette half piece is arranged for mating with the first electrically insulative cassette half piece.

First and second arc chute assemblies are arranged between the first and second electrically insulative cassette half pieces. A first arc chute assembly includes a first side member, a second side member, a tab, and a plurality of plates disposed between the first and second side members and arranged in a stacked spaced-apart relationship. The tab extends from the first side member and through the first recess for properly positioning the first arc chute assembly in the first electrically insulative cassette half piece. A second arc chute assembly includes a third side member, a fourth side member, a tab and a plurality of plates disposed between the third and fourth side member and arranged in a spaced apart relationship. The tab extends from the third side member and through the third recess for properly positioning the second arc chute assembly in the first electrically insulative cassette half piece.

In one embodiment of a circuit breaker cassette assembly, a rotor defining first and second opposing sides thereon includes a pin formed on a first side. The rotor is then properly assembled within the first electrically insulative cassette half piece by placing the pin within the groove. Thus, the rotor is permitted to travel within the groove as required when the circuit breaker is tripped.

DETAILED DESCRIPTION OF THE INVENTION

Figure 1:
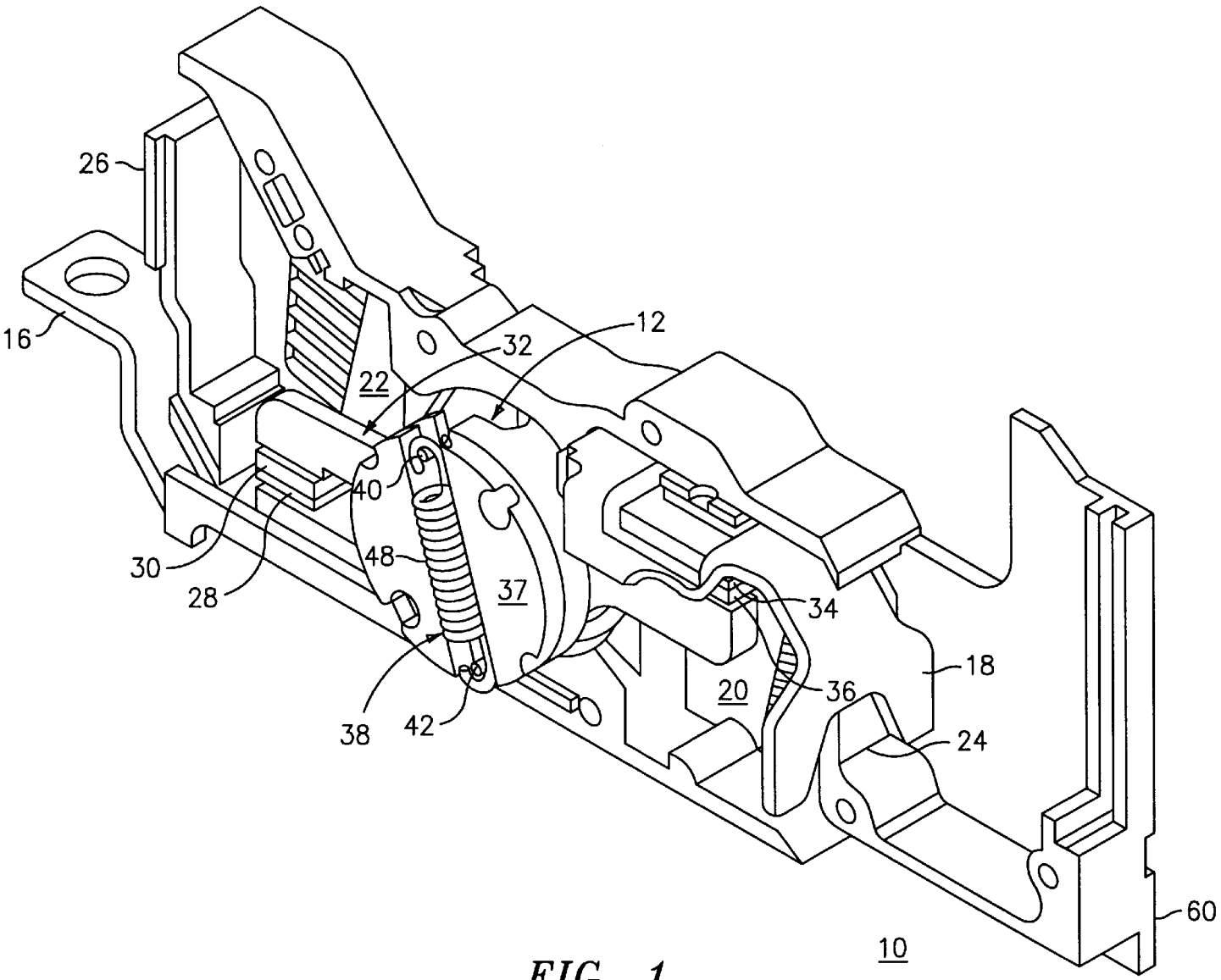
FIG. 1 is a front perspective view of a circuit breaker rotary cassette assembly.

Referring to FIG. 1, a rotary contact assembly 12 in a circuit breaker cassette assembly 10 is shown in an electrically insulative cassette half piece (second electrically insulative cassette half piece) 60 intermediate a line-side contact strap 16, load-side contact strap 18 and associated arc chutes 20, 22. Line-side contact strap 16 is electrically connected to line-side wiring (not shown) in an electrical distribution circuit, and load-side contact strap 18 is electrically connected to load-side wiring (not shown) via a lug (not shown) or some device such as a bimetallic element or current sensor (not shown). Electrically insulative shields 24, 26 separate load-side contact strap 18 and line-side contact strap 16 from the associated arc chute assemblies 20, 22 respectively. Although a single rotary contact assembly 12 is shown, it is understood that a separate rotary contact assembly 12 is employed within each pole of a multi-pole circuit breaker and operate in a similar manner.

Electrical transport through the circuit breaker interior proceeds from the line-side contact strap 16 to associated first fixed and first moveable contacts 28, 30 at one end of a movable contact arm 32, to first fixed and first movable contacts 34, 36 at the opposite end thereof, to the associated load-side contact strap 18. The movable contact arm 32 is arranged between two halves of a circular rotor 37. Moveable contact arm 32 moves in unison with the rotor 37 upon manual articulation of the circuit breaker operating mechanism (not shown) to drive the first and second movable contacts 30, 36 between CLOSED (depicted in FIG. 1) and OPEN positions. A first contact spring 38 extends between a pair of spring pins 40, 42 within the contact spring slot 48 formed within one side of the rotor 37 and a second contact spring (not shown) extends between pins 40, 42 in a similar manner on the opposite side of rotor 37.

The arc chute assemblies 20, 22 are positioned in the electrically insulative cassette half piece 60 adjacent the respective pairs of first fixed and first moveable contacts 28, 30 and second fixed and second moveable contacts 34, 36. The first and second movable contacts 30, 36 and moveable contact arm 32 move through a passageway provided by the arc chute assemblies 20, 22 in order to engage and disengage the respective first and second fixed contacts 28, 34. Each arc chute assembly 20, 22 is adapted to interrupt and extinguish the arc which forms when a circuit breaker is tripped and the first and second moveable contacts 30, 36 are suddenly separated from the first and second fixed contacts 28, 34.

Figure 2:
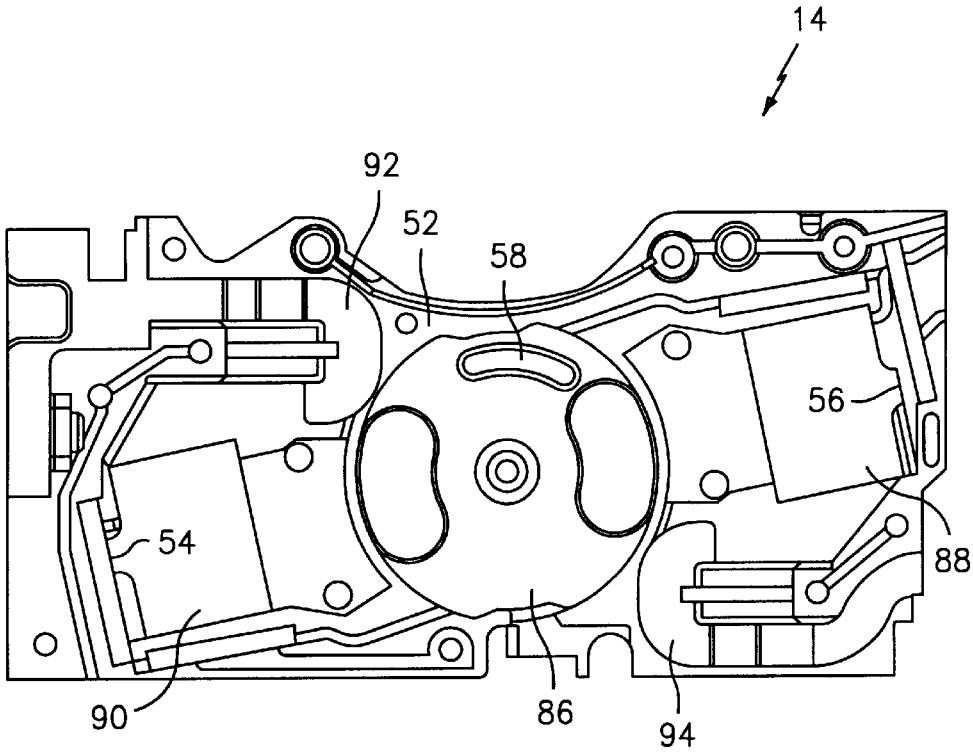
FIG. 2 is a view of a first electrically insulative cassette half piece of the cassette assembly of the present invention showing the rejection features.

Referring to FIG. 2, a first electrically insulative cassette half piece 14 is shown. First electrically insulative cassette half piece 14 has an inner surface 52 having a first recess 56 and second recess 54 formed therein. A groove 58 is also formed on the inner surface 52 of the first electrically insulative cassette half piece 14. A rotor recess 86 is also formed on the inner surface 52. Chute recesses 88, 90 are formed on the inner surface 52 on opposite ends of the rotor recess 86. Load-side and line-side contact strap recesses 92, 94 are also formed on the inner surface 52 proximate the arc chute recesses 88, 90.

Figure 3:
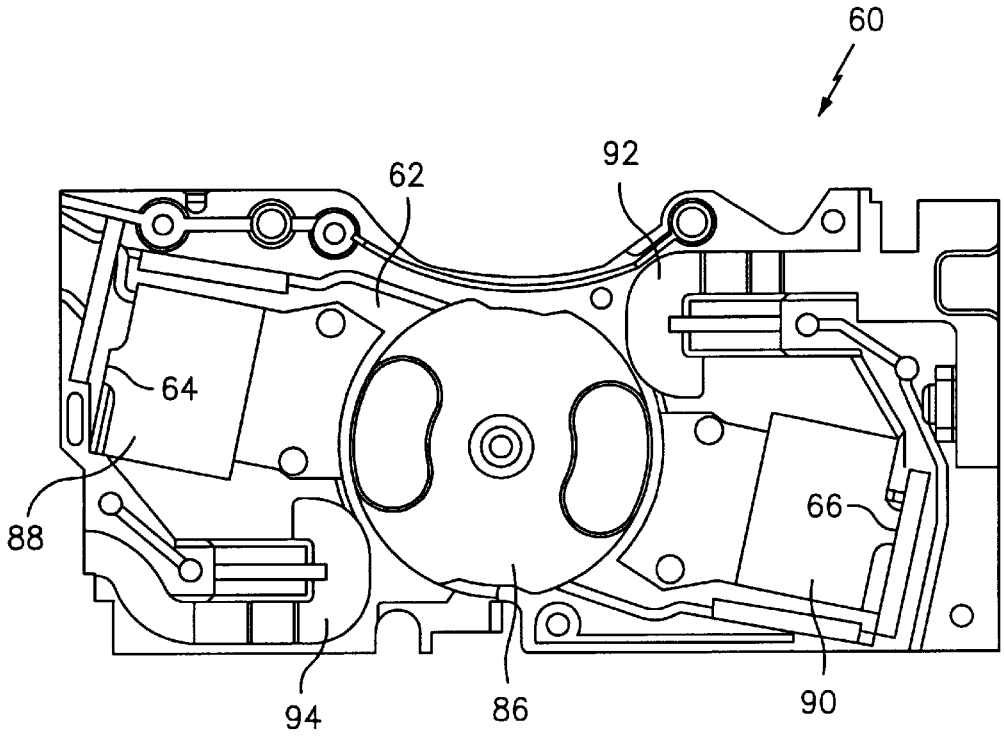
FIG. 3 is a view of a second electrically insulative cassette half piece of a cassette assembly of the present invention showing the rejection features.

Referring to FIG. 3, the second electrically insulative cassette half piece 60 is shown prior to attaching with the first electrically insulative cassette half piece 14 (FIG. 2) to form a complete enclosure. Second electrically insulative cassette half piece 60 has an inner surface 62. Inner surface 62 has a third recess 64 and a fourth recess 66 formed therein. Second electrically insulative cassette half piece 60 is attached to the first electrically insulative cassette half piece 14 (FIG. 2) by suitable mechanical fastening means. A rotor recess 86 is also formed on the inner surface 62. Chute recesses 88, 90 are formed on the inner surface 62 on opposite ends of the rotor recess 86. Load-side and line-side contact strap recesses 92, 94 are also formed on the inner surface 62 proximate the arc chute recesses 88, 90.

Figure 4:
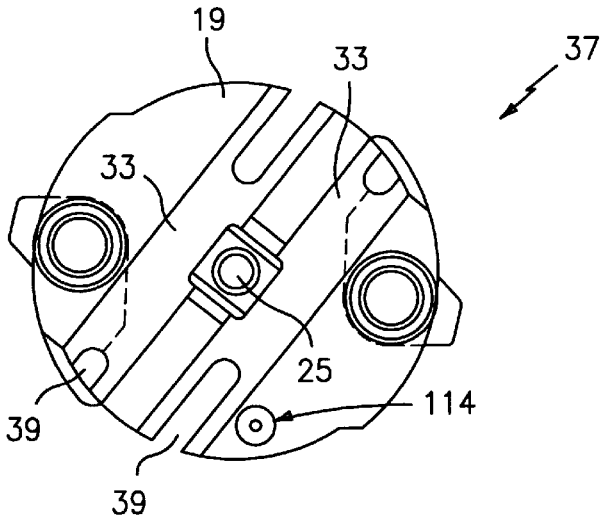
FIG. 4 is a view of a rotor employed in electrically insulative cassette half pieces of FIGS. 2 and 3.

Referring to FIG. 4, a circular rotor 37 is shown prior to being positioned in first electrically insulative cassette half piece 14 (FIG. 2). Rotor 37 is rotatably supported by a shaft (not shown) rotatably and axially mounted inside first electrically insulative cassette half piece 14 (FIG. 2). One or more rotor springs (not shown) are positioned in grooves 33 on face 19. Grooves 33 contain slots 39 disposed lengthwise along grooves 33 for accommodating pins (not shown) to which springs (not shown) are mounted. A pivot pin 25 extends from a central portion of the moveable contact arm 32 to a central portion of the rotor 37 for allowing rotation of the moveable contact arm 32 with respect to the rotor 37. A molded pin 114 extends from the face 19 of rotor 37.

Referring to FIGS. 2 and 4, the rotor 37 is assembled into first electrically insulative cassette half piece 14 by positioning pin 114 into groove 58. The pin 114 permits travel of the rotor 37 within the groove 58. If the pin 114 is not properly set into groove 58 upon assembly of the rotor 37 into the first electrically insulative cassette half piece 14, then the second electrically insulative cassette half piece 60 will not properly mate with the first electrically insulative cassette half piece 14. Thus, the improper completion of the enclosure will be prevented.

Figure 5:
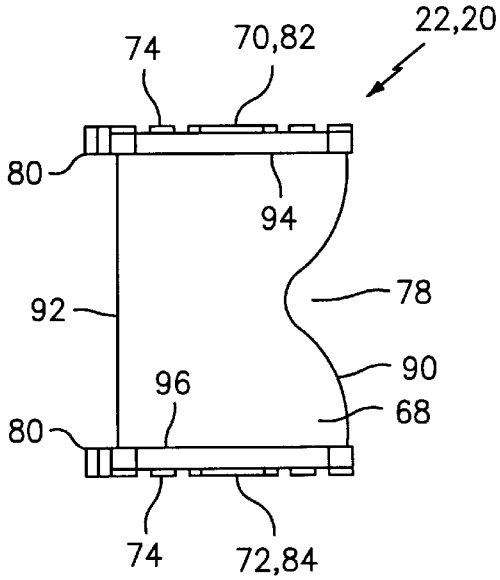
FIG. 5 is a top view of an arc chute assembly positioned in the electrically insulative cassette half pieces of FIGS. 2 and 3.

Referring to FIG. 5 the arc chute assembly 22 for a circuit breaker is shown. The arc chute assembly 22 includes a plurality of plates 68, a first side member 70 and a second side member 72. Typically, the plates 68 are metallic so as to induce magnetism thereby promoting removal of the arc generated by a short circuit trip in the circuit breaker. Each plate 68 has a first edge 90, a second edge 92 opposing the first edge 90, a third edge 94 and a fourth edge 96 opposing the third edge 90. The first edge 90 and the second edge 92 are positioned between the third and fourth edges 94, 96, as shown in FIG. 5. Each plate 68 has a protrusion 74 extending from the third edge 94 and the fourth edge 96. Each plate 68 also includes a radiused notch 78 formed on the first edge 90. The radiused notch 78 provides clearance for the contact arm 32 when the arc chute assembly 22 is mounted within the electrically insulative cassette half pieces 14, 60 (FIGS. 2 and 3).

Figure 6:
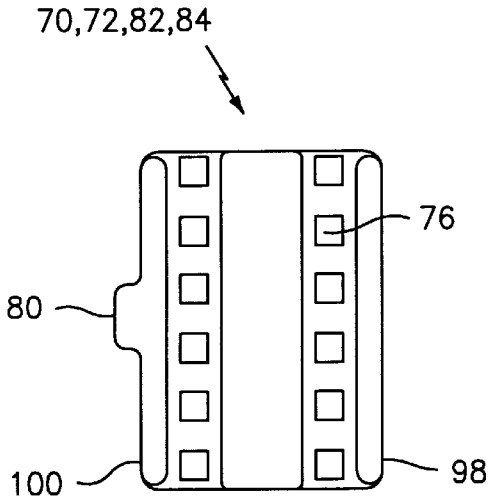
FIG. 6 is a view of an arc chute side member employed in the arc chute assembly of FIG. 5.

Referring to FIGS. 5 and 6, first and second side members 70, 72 have a plurality of slots 76 formed therethrough. The protrusions 74 of the plates 68 are respectively inserted into a corresponding one of the slots 76 formed in the first and second side members 70, 72. The plates 68 are disposed in this manner between the first and second side members 70, 72 and are arranged in a stacked, spaced-apart relationship to each other. Second side member 72 is identical to first side member 70. The first and second side members 70, 72 are assembled so as to be opposedly oriented to each other. First and second side members 70, 72 each include a first end 98 and an opposing second end 100. First side member 70 has a tab 80 centrally located on the second end 100 opposite to the radiused notch 78. A tab 80 is similarly located along second side member 72.

A second arc chute assembly 20 comprises a plurality of plates 68 and third and fourth side members 82, 84. Third and fourth side members 82, 84 are identical to first and second side members 70, 72. Third and fourth side members 82, 84 are assembled so as to be opposedly oriented to each other. Third side member 82 has a tab 80 centrally located on an end opposite to the radiused notch 78 of the plate 68. A tab 80 is similarly located along the fourth side member 84.

Referring to FIGS. 2 and 5, the first arc chute assembly 22 is correctly positioned into the first electrically insulative cassette half piece 14 by placing the tab 80 of the first side member 70 into the first recess 56 of first electrically insulative cassette half piece 14. Similarly, the second arc chute assembly 20 is correctly positioned into the first electrically insulative cassette half piece 14 by placing tab 80 of the third side member 82 into the second recess 54 of first electrically insulative cassette half piece 14.

If a cassette assembly does not include tabs 80 and recesses 56, 54 to correctly position the arc chute assemblies 22, 20 for example, then the radiused notches 78 in the plates 68 might be incorrectly positioned to face opposite the first and second moveable contacts 30, 36 and the first and second fixed 28, 34 contacts. If this were to occur, the moveable contact arm 32 would not be permitted to rotate when the circuit breaker is tripped due to a short circuit event. Also, the arc chute assembly 22 could be placed upside down with respect to the first electrically insulative cassette half piece 14. If this were to occur, there can be insufficient air space between the plate 68 that is closest to the first moveable contact 30 and the line-side contact strap 16. The loss of a conducting plate in the arc chute assembly 22 can result in insufficient an insufficient amount to electromagnetic force to quench the arc. Thus, tabs 80 ensure the correct positioning of the arc chute assemblies 22, 20 within the recesses 56, 54.

Referring now to FIGS. 2, 3, 4 and 5, after the first and second arc chute assemblies 22, 20 are properly assembled into the first electrically insulative cassette half piece 14, the second electrically insulative cassette half piece 60 is placed over the first electrically insulative cassette half piece 14 to form a complete enclosure. As a result, tab 80 of the second side member 72 will be inserted into the third recess 64 of the second electrically insulative cassette half piece 60. Tab 80 of the fourth side member 84 will likewise be inserted into the fourth recess 66 of the second electrically insulative cassette half piece 60. Thus, the first and second arc chute assemblies 22, 20 will be correctly positioned into the first and second electrically insulative cassette half pieces 14, 60. Proper operation of the rotary contact arm assembly is achieved.

The first, second, third and fourth side members 70, 72, 82, 84 have been heretofore described with tabs 80 that are centrally located. The advantage to this arrangement of the tabs 80 along the respective ends of the side members 70, 72, 82, 84 is the cost savings attributed to forming one mold pattern that can be used for all side members 70, 72, 82, 84 for both the first and second arc chute assemblies 22, 20.

Since the first and second arc chute assemblies 22, 20 are assembled prior to placement within the first electrically insulative cassette half piece 14, correct positioning of the first and second arc chute assemblies 22, 20 can also be achieved by using tabs 80 on only the first and third side members 70, 82. In this alternative embodiment, the second and fourth side members 72, 84 would have no tabs 80. However, this would require the manufacture of two structurally different side members. Further, tabs 80 on the first and third side members 70, 82 can be located generally offset as opposed to centrally located along the edges of the respective side members. However, this would further require the manufacture of a third type of side member to accommodate the offset tab arrangement.

As described herein, a cassette assembly for rotary contact circuit breakers utilizing a first electrically insulative cassette half piece 14 and a second electrically insulative cassette half piece 60 are arranged to mate with each other to form an enclosure. The electrically insulative cassette half pieces 14, 60 include improper installation rejection features for both the rotor 37 and the arc chute assemblies 22, 20. Therefore, the cassette assembly, as described herein, prevents such disassembly and reassembly that can be time consuming and increase the production cost of the circuit breaker.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but rather that the invention will include all embodiments falling within the scope of the appended claims.

What is claimed is:

1. A circuit breaker rotary contact assembly comprising:

a first electrically insulative cassette half piece having an inner surface, said inner surface having a groove;

a second electrically insulative cassette half piece arranged for mating with said first electrically insulative cassette half piece;

a rotor defining first and second opposing sides thereon, said rotor including a pin formed on said first side;

a moveable contact arm intermediate said first and second sides, said moveable contact arm defining a first moveable contact at one end arranged opposite an opposing first fixed contact and a second movable contact at an end opposite said one end arranged proximate a second fixed contact, said rotor and said moveable contact arm being retained intermediate said first and second electrically insulative cassette half pieces; and a pivot pin extending from a central portion of said moveable contact arm to a central portion of said rotor for allowing rotation of said moveable contact arm with respect to said rotor;

wherein said pin extends within said groove and allows said first electrically insulative cassette half piece to mate with said second electrically insulative cassette half piece and allows said movable contact arm to rotate said first movable contact to contact said first fixed contact and said second movable contact to contact said second fixed contact.

2. A circuit breaker assembly comprising:

a line-side contact strap arranged for connection with an electric circuit, said line-side contact strap including a first fixed contact connected to said line-side contact strap;

a load-side contact strap arranged for connecting with associated electrical equipment, said load-side contact strap including a second fixed contact connected to said load-side contact strap; and a circuit breaker rotary contact assembly disposed between said line and load-side contact straps, said circuit breaker rotary contact assembly including:

a first electrically insulative cassette half piece having an inner surface, said inner surface having a groove, a second electrically insulative cassette half piece arranged for mating with said first electrically insulative cassette half piece, a rotor defining first and second opposing sides thereon, said rotor including a pin formed on said first side, a moveable contact arm intermediate said first and second sides, said moveable contact arm defining a first moveable contact at one end arranged opposite said first fixed contact and a second movable contact at an end opposite said one end arranged proximate said second fixed contact, said rotor and said moveable contact arm being retained intermediate said first and second electrically insulative cassette half pieces, and a pivot pin extending from a central portion of said moveable contact arm to a central portion of said rotor for allowing rotation of said moveable contact arm with respect to said rotor;

wherein said pin extends within said groove and allows said first electrically insulative cassette half piece to mate with said second electrically insulative cassette half piece and said movable contact arm to rotate said first movable contact to contact with said first fixed contact and said second movable contact to contact with said second fixed contact.

3. The circuit breaker assembly of claim 2 further comprising a first arc chute assembly arranged between said first and second electrically insulative cassette half pieces, wherein said inner surface of said first electrically insulative cassette half piece includes a first recess formed therein, said first arc chute assembly including:

a first side member having a first end and an opposing second end;

a second side member having a first end and an opposing second end;

a tab extending from said second end of said first side member and through said first recess for positioning said first arc chute assembly in said first electrically insulative cassette half piece; and a plurality of plates disposed between said first and second side members and arranged in a stacked spaced-apart relationship and each of said plurality of plates respectively including a notch, said notch formed in a first edge of each of said plurality of plates and opposed to said tab.

4. The circuit breaker assembly of claim 3 further comprising a second arc chute assembly arranged between said first and second electrically insulative cassette half pieces, wherein said inner surface of said first electrically insulative cassette half piece includes a second recess formed therein, said second arc chute assembly including:

a third side member having a first end and an opposing second end;

a fourth side member having a first end and an opposing second end;

a tab extending from said second end of said third side member and through said second recess for positioning said second arc chute assembly in said first electrically insulative cassette half piece; and a plurality of plates disposed between said third and fourth members and arranged in a stacked spaced-apart relationship and each of said plurality of plates respectively including a notch formed in a first edge of each of said plurality of plates and opposed to said tab of said third side member.

5. The circuit breaker assembly of claim 4 wherein said second end of said first side member includes an upper end and a lower end, and a mid-point located along said second end of said first side member between said upper and lower ends and wherein said tab is located at said mid-point of said first side member, wherein said second end of said third side member includes an upper end and a lower end, and a mid-point located along said second end of said third side member between said upper and lower ends and wherein said tab is located at said mid-point of said third side member.

6. The circuit breaker assembly of claim 4 wherein said second end of said second side member includes an upper end and a lower end, and a mid-point located along said second end of said second side member between said upper and lower ends and wherein said tab is located at said mid-point of said second side member, wherein said second end of said fourth side member includes an upper end and a lower end, and a mid-point located along said second end of said fourth side member between said upper and lower ends and wherein said tab is located at said mid-point of said fourth side member.

7. The circuit breaker assembly of claim 3 wherein said first and second side members includes a plurality of slots formed therethrough and each of said plurality of plates respectively includes a second edge opposing said first edge, a third edge and a fourth edge opposing said third edge, said third edge and said fourth edge contiguous with said first and second edges and each of said plurality of plates respectively includes a protrusion extending from each of said third and fourth edges, said protrusions extend through said slots in said first and second side members.

8. The circuit breaker assembly of claim 4 wherein said third and fourth side members include a plurality of slots formed therethrough and each of said plurality of plates respectively includes a second edge opposing said first edge, a third edge and a fourth edge opposing said third edge, said third edge and said fourth edge contiguous with said first and second edges and each of said plurality of plates respectively includes a protrusion extending from each of said third and fourth edges, said protrusions extend through said slots in said third and fourth side members.

* * * * *